US005668584A

United States Patent [19]

Broder et al.

[11] Patent Number: 5,668,584

[45] Date of Patent: Sep. 16, 1997

[54] METHOD OF MULTIPLE ZONE HEATING OF INKJET MEDIA USING SCREEN PLATEN

[75] Inventors: Damon Broder, Austin, Tex.; Shelley I. Moore, San Diego, Calif.; Todd R. Medin, Vancouver, Wash.; Brent W. Richtsmeier, San Diego, Calif.

[73] Assignee: Hewlett-Packard Company, Palo Alto, Calif.

[21] Appl. No.: 238,091

[22] Filed: May 3, 1994

Related U.S. Application Data

[63] Continuation-in-part of Ser. No. 876,942, May 1, 1992, Pat. No. 5,329,295, Ser. No. 56,287, Apr. 30, 1993, Pat. No. 5,479,199, and Ser. No. 7,766, Apr. 30, 1993, Pat. No. Des. 358,418.

[51] Int. Cl.[6] ..... B41J 2/01; B41J 11/02

[52] U.S. Cl. ..... 347/102

[58] Field of Search ..... 347/102, 43, 87

[56] References Cited

U.S. PATENT DOCUMENTS

| | | | |
|---|---|---|---|
| 4,712,172 | 12/1987 | Kiyohara et al. | 347/87 |
| 4,982,207 | 1/1991 | Tunmori et al. | 347/102 |

FOREIGN PATENT DOCUMENTS

| | | | |
|---|---|---|---|
| 107735 | 8/1979 | Japan | 347/102 |
| 109645 | 5/1987 | Japan | 347/102 |
| 62738 | 3/1988 | Japan | 347/102 |
| 283957 | 11/1988 | Japan | 347/102 |
| 2-6141 | 1/1990 | Japan | 347/43 |
| 180348 | 8/1991 | Japan | 347/102 |
| 481829 | 4/1992 | Japan | 347/102 |
| 141425 | 5/1992 | Japan | 347/102 |
| 90/0962 | 8/1990 | WIPO . | |

*Primary Examiner*—N. Le

*Attorney, Agent, or Firm*—David S. Romney

[57] ABSTRACT

An inkjet printer applies ink from one or more printheads to media which is supported by a screen platen. The screen platen allows transfer of heat by radiation and convection from a heat generator unit to pre-printing portion of the print zone, an ink-applying portion of the print zone, and a post-printing portion of the print zone.

19 Claims, 11 Drawing Sheets

METHOD OF MULTIPLE ZONE HEATING OF INKJET MEDIA USING SCREEN PLATEN

RELATED APPLICATIONS

This is a CIP of the following cases: "Print Zone Heater Screen For Thermal Ink-Jet Printer", Ser. No. 07/876,942 filed May 1, 1992, now U.S. Pat. No. 5,329,295, in the name of Todd R. Medin and Brent W. Richtsmeier; "Print Zone Radiant Heater For Ink-jet Printer", Ser. No. 08/056,287 filed Apr. 30, 1993, now U.S. Pat. No. 5,479,199, in the name of Shelley I. Moore, Brent W. Richtsmeier, et al.; and "Printer Platen", Ser. No. 29/007,766 filed Apr. 30, 1993, now Des. Pat. No. D358,418, in the name of Damon W. Broder and Shelley I. Moore, all of which are incorporated herein by reference.

BACKGROUND OF THE INVENTION

The present invention relates to the field of computer inkjet printer, and more particularly to apparatus and techniques for improving the print quality of color thermal ink jet printer.

An inkjet printer forms a printed image by printing a pattern of individual dots at particular locations of an array defined for the printing medium. The locations are conveniently visualized as being small dots in a rectilinear array. The locations are sometimes "dot locations", "dot positions', or "pixels". Thus, the printing operation can be viewed as the filling of a pattern of dot locations with dots of ink.

Ink jet printers print dots by ejecting very small drops of ink onto the print medium, and typically include a movable carriage that supports one or more printheads each having ink ejecting nozzles.

The ink cartridge containing the nozzles is moved repeatedly across the width of the medium to be printed upon. At each of a designated number of increments of this movement across the medium, each of the nozzles is caused either to eject ink or to refrain from ejecting ink according to the program output of the controlling microprocessor. Each completed movement across the medium can print a swath approximately as wide as the number of nozzles arranged in a column on the ink cartridge multiplied times the distance between nozzles centers. After each such completed movement or swath, the medium is moved forward the width of the swath, and the ink cartridge begins the next swath. By proper selection and timing of the signals, the desired print is obtained on the medium.

In order to obtain multicolored printing, color thermal inkjet printers commonly employ a plurality of printheads, for example four, mounted in the print carriage to produce different colors. Each printhead contains ink of a different color, with the commonly used colors being cyan, magenta, yellow, and black. These base colors are produced by depositing a drop of the required color onto a dot location, while secondary or shaded colors are formed by depositing multiple drops of different base color inks onto the same dot location, with the overprinting of two or more base colors producing secondary colors according to well established optical principles.

Print quality is one of the most important considerations of competition in the color inkjet printer field. Since the image output of a color inkjet printer is formed of thousands of individual ink drops, the quality of the image is ultimately dependent upon the quality of each ink drop and the arrangement of the ink drops on the print medium. One source of print quality degradation is insufficient drying of a first deposition ink drop prior to deposit of an overlying second ink drop.

Current inkjet technology printers are not able to print high density plots on plain paper without suffering two major drawbacks: the saturated media is transformed into an unacceptably wavy or cockled sheet; and adjacent colors tend to run or bleed into one another.

Hardware solutions to these problems have been attempted. Heating elements have been used to dry the ink rapidly after it is printed. But this has helped only to reduce smearing that occurs after printing. Prior art heating elements have not been effective to reduce the problems of ink migration that occur during printing and in the first few fractions of a second after printing.

SUMMARY OF THE INVENTION

A thermal inkjet printer is described for printing onto a print medium in a heated printed environment. The printer includes a printhead for printing on a print medium, comprising a plurality of thermal inkjet nozzles disposed above a print zone for ejecting droplets of ink onto the surface of the medium in a controlled fashion. The printer also includes means for advancing the print medium along a print advancement direction to the print zone beneath the printhead during print operations.

Print heater means is provided for heating the medium to cause accelerated drying of ink deposited on the print medium. The heater means comprises a heat source disposed beneath the medium at the print zone.

In accordance with the invention, a heater screen member is disposed at the print zone for supporting the print medium in the vicinity of the print zone and for permitting convective and radiant heat transfer from the heat source to the medium, for the drying of adjacent ink drops as well as prior to application of any overlying ink drops.

In a first embodiment, a thermal inkjet printer includes a print carriage movable along a carriage scan axis, a plurality of color producing inkjet printheads supported by the print carriage and offset relative to each other so that their nozzle arrays are non-overlapping along the media scan axis, whereby the nozzle arrays of said inkjet printheads traverse non-overlapping regions in the print zone as the carriage is scanned along the carriage scan axis. In a second embodiment, a plurality of color producing inkjet printheads are mounted in aligned positions in a carriage so that their nozzle arrays are overlapping along the media scan axis. In both embodiments, the screen platen allows heat transfer to a first pre-print region in the print zone, a second ink-applying region in the print zone, and a third post-print region in the print zone for each of the nozzle arrays.

DETAILED DESCRIPTION OF PREFERRED EMBODIMENTS

Figure 1:
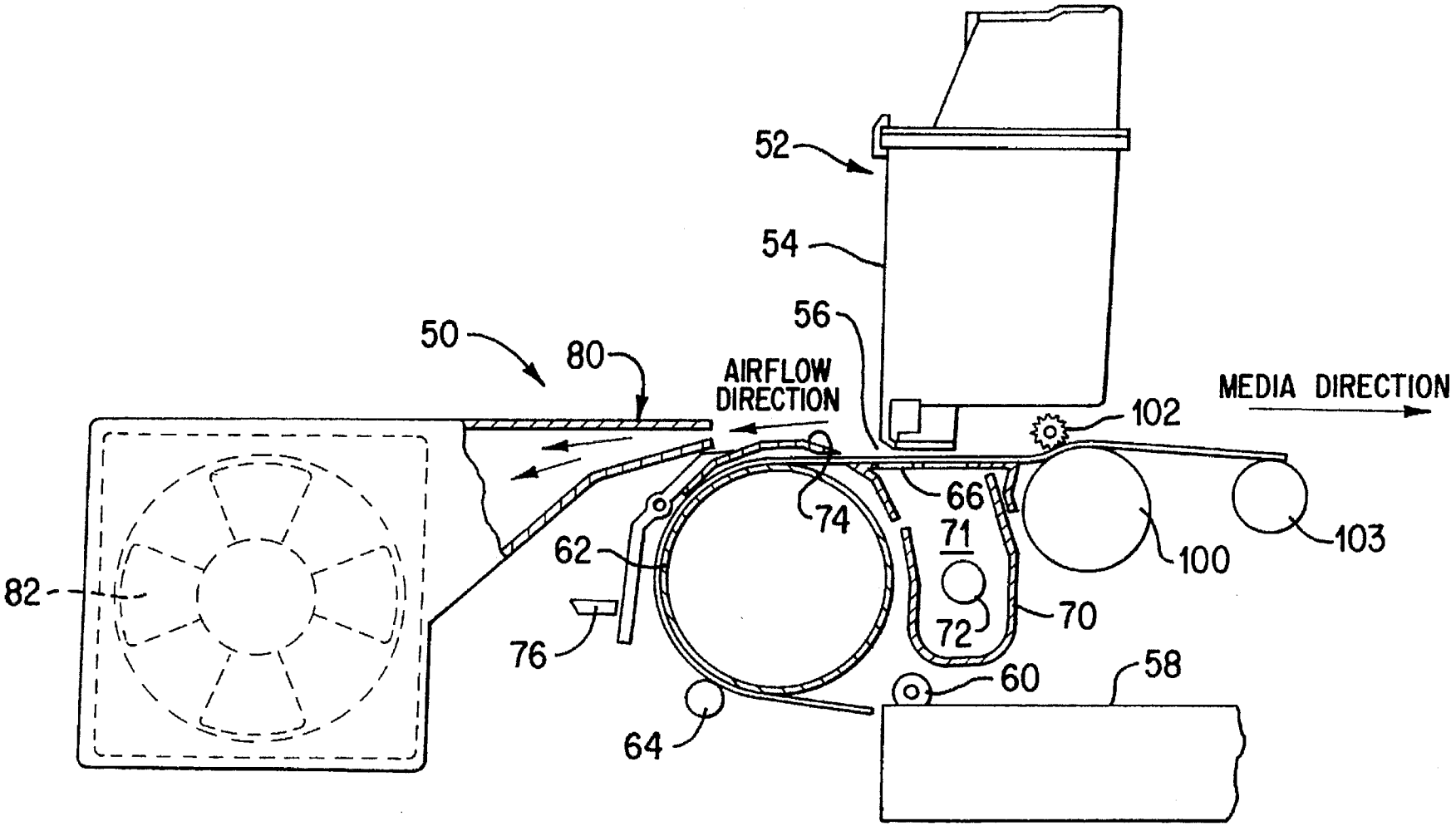
FIG. 1 is a simplified schematic diagram illustrative of a first embodiment of a color inkjet printer embodying the present invention.

In a first embodiment of the invention shown in FIGS. 1–8, a printer 50 includes a means for driving the print medium in the media advance direction, and for controlling the movement of a printhead, indicated generally as element 52 in FIG. 1, in a carriage scan (orthogonal to the plane of FIG. 1), in order to direct ink from the ink cartridges, shown generally as elements 45, onto print media at the print region 56. In this embodiment, the printhead 52 supports four ink cartridges for black, yellow, magenta and cyan inks, respectively.

The print medium in this first embodiment is supplied in sheet form from a tray 58. A pick roller 60 is employed to advance the print medium from the tray 58 into engagement between drive roller 62 and idler roller 64. Exemplary types of print medium include plain paper, coated paper, glossy opaque polyester, and transparent polyester.

The printer operation is controlled by a controller which receives instructions and print data from a host computer in the conventional manner. The host computer may be a workstation or personal computer, for example.

Once the print medium has been advanced into the nip between the drive and idler rollers 62 and 64, it is advanced further by the rotation of the drive roller 62. A stepper drive motor 92 is coupled via a gear train to roller 62 to drive the rollers 60, 62, 100 and 103 which drive the medium through the printer media path.

The print medium is fed to a print zone 56 beneath the area traversed by the cartridges 54 and over a print screen 66 which provides a means of supporting the medium at the print position. The screen 66 further allows efficient transfer of radiant and convective energy from the print heater cavity 71 to the print medium as well as providing a safety barrier by limiting access to the inside of the reflector 70.

While the medium is being advanced, a movable drive plate 74 or media hold is lifted by a cam 76 actuated by the printhead carriage. Once the print medium reaches the print zone 56, the drive plate 74 is dropped, holding the medium against the screen 66, and allowing minimum spacing between the print nozzles of the thermal ink-jet print cartridges and the medium. This control of the medium in the print zone is important for good print quality. Successive swaths are then printed onto the print medium by the ink-jet head comprising the different print cartridges 54.

A print heater halogen quartz bulb 72 disposed longitudinally under the print zone 56 supplies a balance of thermal radiation and convective energy to the ink drops and the print medium in order to evaporate the carrier in the ink. This heater allows dense plots (300 dots per inch in this embodiment) to be printed on plain paper (medium without special coatings) and achieve satisfactory output quality in an acceptable amount of time. The reflector 70 allows radiated energy to be focused in the print zone and maximizes the thermal energy available.

An evacuation duct 80 leads to an evacuation fan 82. The duct defines the path used to remove ink vapors from around the print zone 56. The evacuation fan 82 pulls air and vapor from around the print zone into the duct 80 and out an evacuation opening. Evacuation of the ink vapors minimizes residue buildup on the printer mechanism.

An exit roller 100 and starwheels 102 and an output stacking roller 103 work in conjunction with the heated drive roller 62 to advance and eject the print medium. The gear train driving the gears is arranged such that the exit roller drives the medium is under some tension once engaged by the exit roller. The frictional force between the print medium and the respective rollers is somewhat less that the tensile strength of the print medium so there is some slippage of the print medium on the rollers. The tension facilities good print quality keeping the print medium flat under the print zone.

When the printer 50 is turned on, and power is applied to the printer, a warm-up algorithm is initiated. When the correct operating conditions are reached by the warm-up algorithm, printing is achieved by firing drops of ink from the ink cartridges 54 while they are traversing the medium in a printhead sweep. The carrier in the ink is evaporated by the heat generated by the print heater bulb 72. The carrier vapor is directed by the airflow toward the evacuation duct 80, where it is removed through the evacuation fan. The drive roller 62 advances the medium to the next line or sweep to be printed. In the event the print stream is interrupted, the heater 72 is turned off.

The evacuation fan 82 runs at all times the printer is on and is either printing or ready to print.

Different print modes are employed depending on the medium type. One pass mode operation is used for increased throughput on plain paper. Use of this mode on other papers will result in too large of dots on coated paper, and ink coalescence on polyester media. The one pass mode is one in which all dots to be fired on a given row of dots are placed on the medium in one swath of the print head, and then the print medium is advanced into position for the next swath.

The three pass mode is a print pattern wherein one third of the dots for a given row of dots swath are printer on each pass of the printhead, so three passes are needed to complete the printing for a given row. Typically, each pass prints the dots on one third of the swath area, and the medium is advanced by one third the distance to print the next pass as in the one pass mode. This mode is used to allow time for the ink to evaporate and the medium to dry, to prevent unacceptable cockle and ink bleeding.

Similarly, the four pass mode is a print pattern wherein one fourth of the dots for a given row are printer don each pass of the printhead. For a polyester medium, the four pass mode is used to prevent unacceptable coalescence of the ink on the medium.

Multiple pass thermal ink-jet printing is described, for example, in commonly assigned U.S. Pat. Nos. 4,963,882 and 4,965,593.

In general it is desirable to use the minimum number of passes per full swath area to complete the printing, in order to maximize the throughput.

Figure 2:
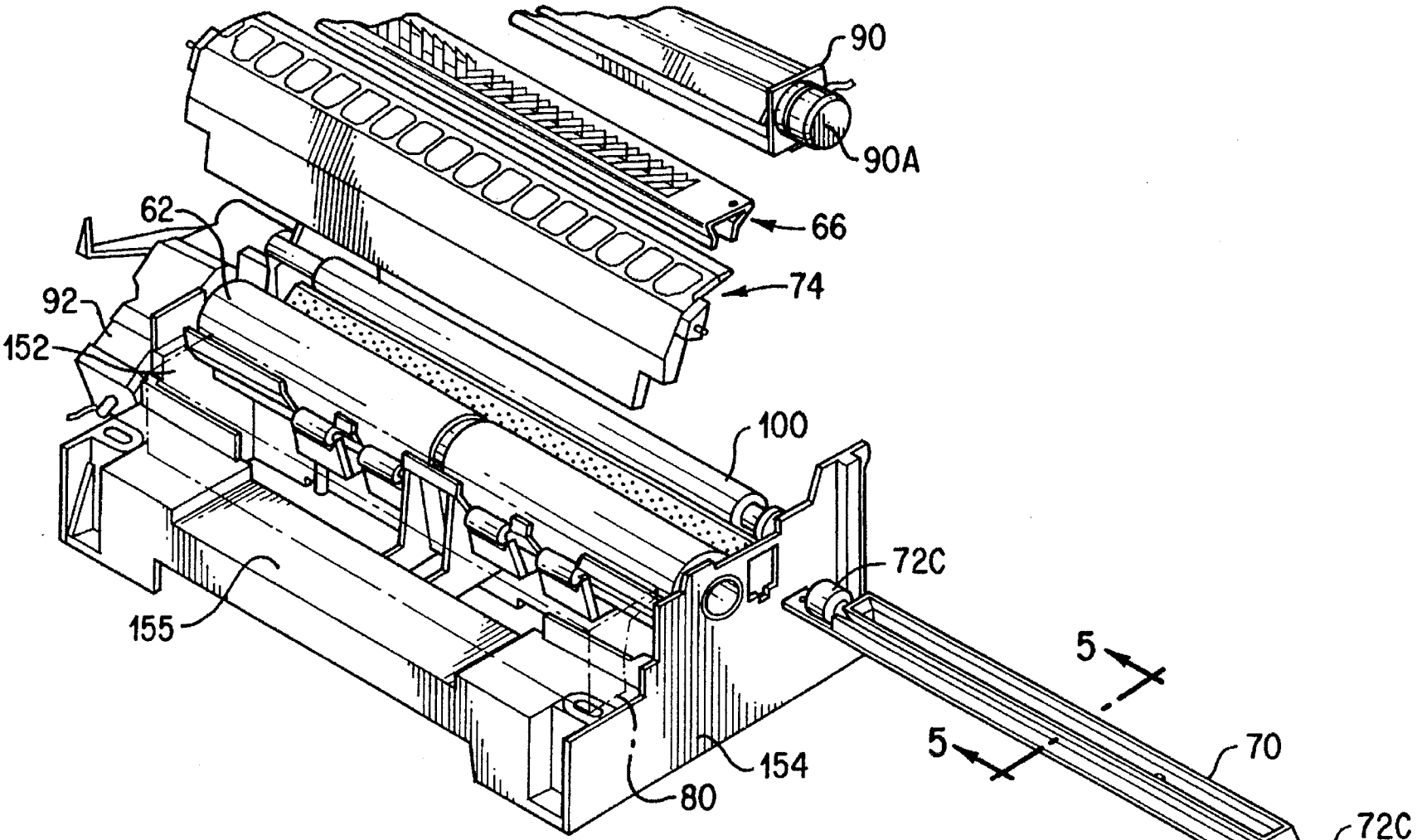
FIG. 2 is a partially-exploded perspective view showing various elements of the printer of FIG. 1, including the print zone heater element and screen.
Figure 3:
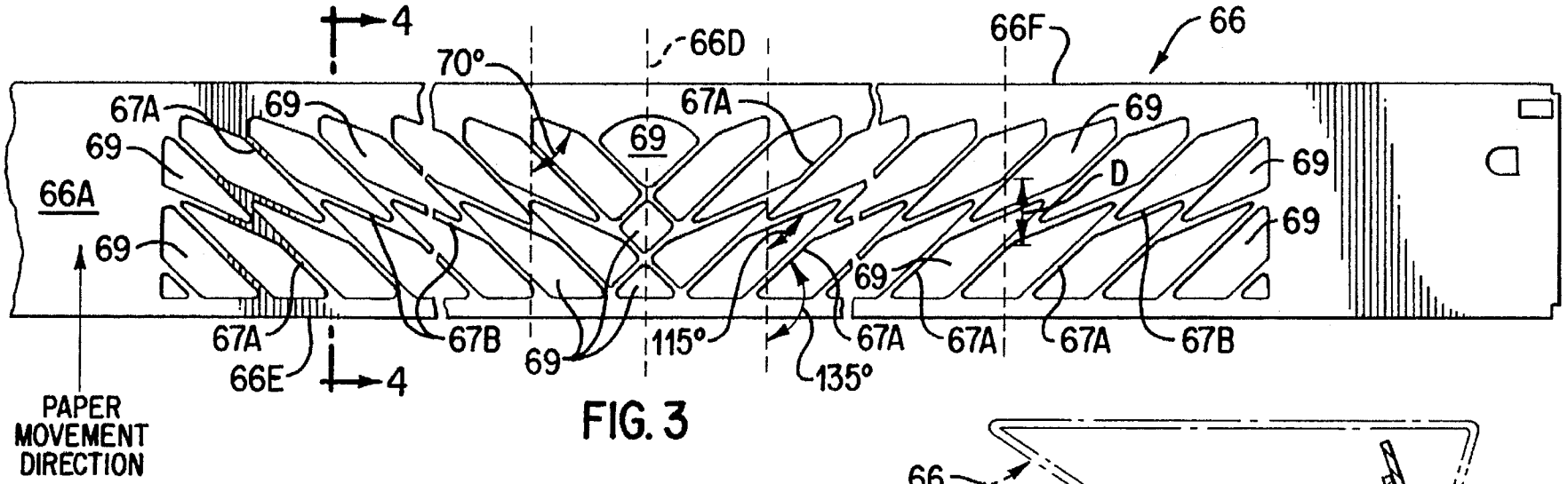
FIG. 3 is a top view of the heater screen shown in FIG. 1.
Figure 4:
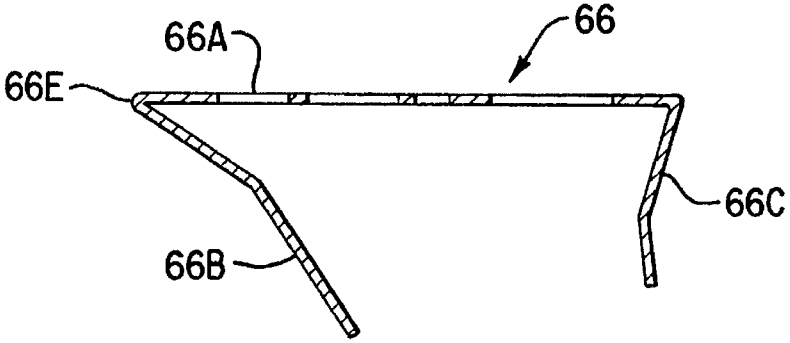
FIG. 4 is a side cross-sectional view of the heater screen, taken along line 4—4 of FIG. 3.

The print zone screen 66 in this first embodiment is further illustrated in FIGS. 2,3 and 4, and performs several functions. It supports the paper at the print zone and above the heater reflector 70. The screen is strong enough to prevent users from touching the heater element 72. The screen transmits radiative and convective heat energy to the print medium, while transmitting little if any conductive heat energy, which would cause print anomalies, due to nonuniform heat transfer. The screen 66 must be designed such that the print medium does not catch a surface of the screen as it is driven through the print zone.

The screen 66 performs these functions by the placement of a network of thin primary and secondary webs, nominally 0.030 inches in width, which outline relatively large screen openings. Exemplary ones of the primary and secondary webs are indicated as respective elements 67A and 67B in FIG. 3; exemplary screen openings are indicated as "69" in FIG. 3. The purpose of the secondary webs is to provide additional strength to meet safety requirements.

Figure 5:
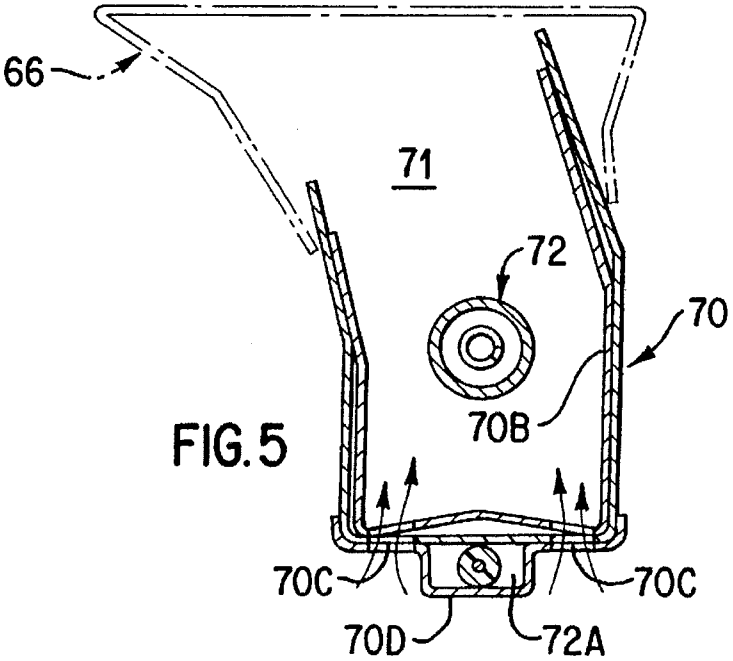
FIG. 5 is a side cross-sectional view of the print heater and reflector assembly, taken along line 5—5 of FIG. 2.

The screen 66 is preferably made from a high strength material such as stainless steel, in this embodiment about 0.010 inches in thickness. The openings 69 can be formed by die cutting or etching processes. The screen is processed to remove any burs which might catch the medium. FIG. 4 shows a cross-sectional view, and illustrates the top surface 66A which joins side flanges 66B and 66C. The screen fits over the top of the reflector 70 as illustrated in FIG. 5.

Typical dimensions for the screen include a screen opening pattern width (i.e., the dimension in the direction of medium travel) of 0.810 inches (20.5 mm), and opening 69 width and length dimensions of 0.310 inches (8 mm) and 0.470 inches (12 mm), respectively. The print zone width (in the direction of medium travel) for the exemplary printhead 52 of this embodiment is 0.530 inches (13.5 mm) covering the region subtended by three stagger print cartridges, each print cartridge employing 48 print nozzles aligned in a row.

Referring again to FIG. 3, the screen grid pattern is essentially a mirror image about the center axis 66D. Viewed from the edge 66E of the screen initially traversed by the print medium, the primary webs 67A are at a first obtuse angle relative to a line perpendicular to the edge 66E, which angle in this embodiment is 135 degrees. The secondary webs 67B are at a second obtuse angle relative to a line perpendicular to edge 66E, which in this embodiment is 115 degrees. The edges of the openings 69 which are adjacent the edge 66F of the screen are at a 70 degree angle relative to a line perpendicular to the screen edge 66E. These angles are selected in order to provide a web network which has the requisite strength to prevent users from touching the bulb 72 and yet which permits the ready transfer of radiant and convective heat energy from the radiator cavity to the print medium.

The angle of the primary webs 67A is determined by several factors. The web angles must first meet the requirement that the leading edge of the medium not catch on the webs as the medium is advanced. Also, the web angles are also selected in dependence on the medium advance distance between adjacent print swaths. This distance is determined by the number of print nozzles and the print mode. In this exemplary embodiment, the printhead comprises 48 print nozzles in a row, spaced over a distance of 0.160 inches (4.1 mm). Including the spacing between staggered cartridges, the total width of the area subtended by the printhead in this exemplary embodiment is 0.530 inches (13.5 mm). For a single pass mode the medium advance distance for each successive swath is 0.160 inches, i.e., the width of the area subtended by the print nozzle of a single one of the staggered print cartridges. For a three pass mode, the distance is one-third the single pass distance, or 0.053 inches. For the four pass mode, the distance is 0.040 inches, i.e., one-fourth the medium advance distance for the single pass mode.

The width of the screen opening pattern is determined in the following manner for this exemplary printer embodiment. The opening pattern width can be considered to have three regions, the first a pre-heat region for preheating the advancing medium before reaching the active print zone. The second region is the active print zone, i.e., the area subtended by the print nozzles comprising the printhead. In this embodiment, this area is defined by the nozzle coverage of three staggered print cartridges. The third region is a post-print heating region, reached by the medium after being advanced through the active print zone. In this embodiment, the pre-heat region width is equal to two multi-pass medium advancement distances; this is equal to 2(0.160 inches)/3, or about 0.105 inches. The active print zone region has a width of 0.530 inches, for the staggered three print cartridge embodiment, as described above. The post-print heating region has a width equal to a single pass mode increment distance, or 0.160 inches. The three regions aggregate approximately 0.8 inches in this embodiment.

The web angles are such that the vertical distance D between webs (i.e., the distance D on a perpendicular line to the screen edge 66E between webs as shown in FIG. 3) is not an integral multiple of the medium advance distance. This prevents the same point on the medium from being shielded from the heater cavity by adjacent webs in successive positions as the medium is advanced during printing. Such shielding would affect the drying rate slightly, and web patterns in the finished print copy could be seen if this shielding were not prevented. The problem is evident if one considers the use of vertical webs, i.e., webs which are parallel to the direction of advancement of the medium, which obviously would not catch the medium as it is advanced. However, the same areas of the medium, those disposed over webs, will be shielded from the print cavity as the medium is advanced, and this area will dry differently than unshielded areas, showing the vertical web pattern.

By way of example, the preferred embodiment, with a primary web angle of 135 degrees, employs a vertical spacing distance D between adjacent primary webs 67A of approximately 9 millimeters (0.355 inches), wherein a three pass medium advance distance is 1.4 millimeters(0.055 inches). This is about 6.4 advances, i.e., not an integral multiple.

Figure 6:
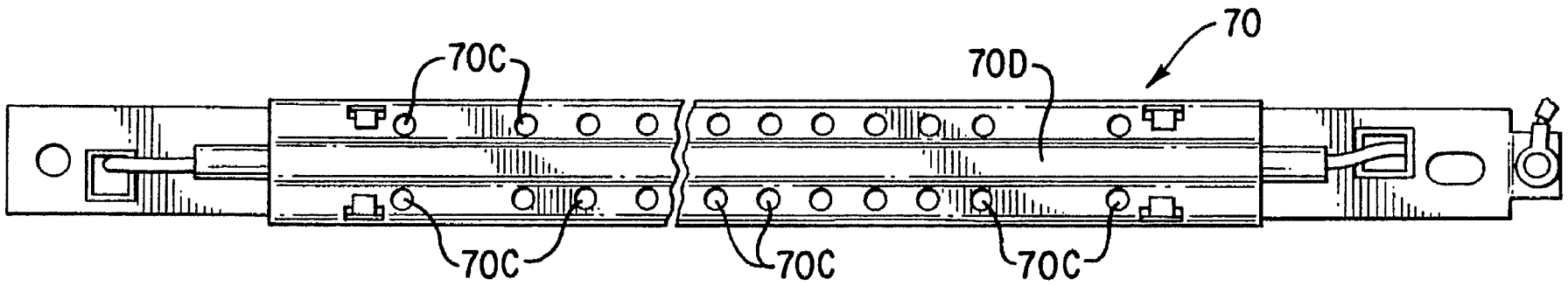
FIG. 6 is a bottom view of the heat reflector of the printer of FIG. 1.

The print heater bulb 72 and reflector are shown in FIGS. 2, 5 and 6 in further detail. The bulb 72 is a quartz halogen lamp, 13 inches in length. It is supported longitudinally at each end thereof within the reflector cavity 71 by conventional bushing elements 72C (shown in FIG. 2). In this exemplary embodiment, the lamp is a 90 volt, 200 watt bulb. A thermal fuse 72A is provided in the power circuit cable disposed in a channel 70D disposed at the bottom of the reflector 70, to comply with UL safety requirements.

The reflector 70 further comprises an inner liner 70B which has an inner surface which is highly reflective of infrared energy. The reflector 70 is fabricated from a material, such as galvanized steel, which can withstand the heat generated by the bulb 72, and which supports a highly reflective aluminum inner liner 70B to reflect the heat energy generated by the bulb toward the screen 66 which is assembled to the top of the reflector cavity. The bottom of the liner 70B is peaked under the bulb 72 so as to reflect energy directed downwardly by the bulb toward the sides of the liner for further reflection upwardly to the screen 66. Without the peak, some of such downwardly directed energy would be directed back to the bulb, blocking this portion of the heat from the screen, heating the bulb unnecessarily and wasting a portion of the heat energy.

As shown more clearly in the reflector bottom view of FIG. 6, a plurality of holes 70C are formed in both the reflector and its inner liner. In this embodiment, the holes in the reflector have a diameter of 0.125 inches (3.2 mm), and the corresponding holes in the reflector inner liner have a diameter of 0.100 inches (2.5 mm). Such holes provide a means for air to enter the bottom of the reflector and circulate upwardly through openings in the screen 66. The holes therefor increase the convective heat transfer from the reflector cavity 71 to the screen, and to allow cool air to flow into the cavity, thereby decreasing the maximum temperature of the assembly.

Figure 7:
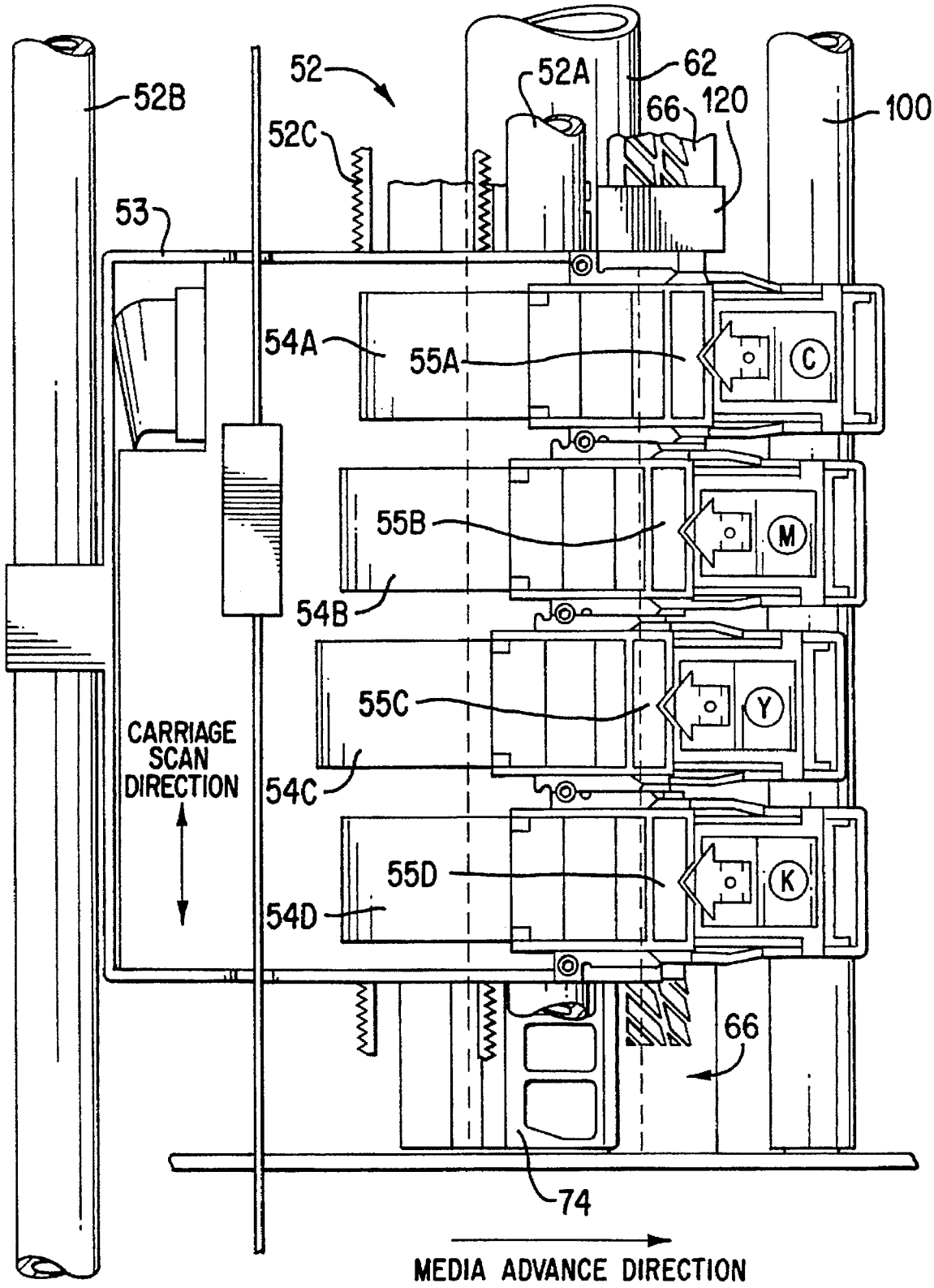
FIG. 7 is a top view illustrating the staggered printheads of the printer of FIG. 1.

FIG. 7 illustrates a partially broken away top view of the printhead unit 52 with four thermal inkjet cartridges 54A–D in a carriage 53 supported on parallel ways 52A and 52B for sliding movement along the ways. This drawing exemplifies the differently sized screen platen regions (preheat region, active print zone region, post-print heating region) associated with each different nozzle array location 55A–D, depending on their respective staggered positions over the screen platen. Thus, nozzle array 55A of the cyan cartridge 54A has the largest preheat region; nozzle arrays 55B and 55D of the magenta and black cartridges 54B and 54D have the next largest preheat region; and nozzle array 55C of the yellow cartridge 54C has the smallest preheat region. Conversely, the yellow nozzle array 55C has the largest post-print heating region; the magent and black nozzle arrays 55B and 55D have the next largest post-print heating region; and the cyan nozzle array 55A has the smallest post-print heating region.

This first printer/printhead embodiment and its operation are described more fully in the commonly assigned co-pending application entitled "Staggered Pens In Color Thermal Ink-Jet Printer," filed May 1, 1992, Ser. No. 07/877,905 by B. W. Richtsmeier. A. N. Doan and M. S. Hickman, the entire contents of which are incorporated herein by this reference. As described therein, the yellow, magenta and cyan print cartridges are staggered, so that the print nozzles of each cartridge subtend non-overlapping regions at the print zone of the printer.

Figure 8:
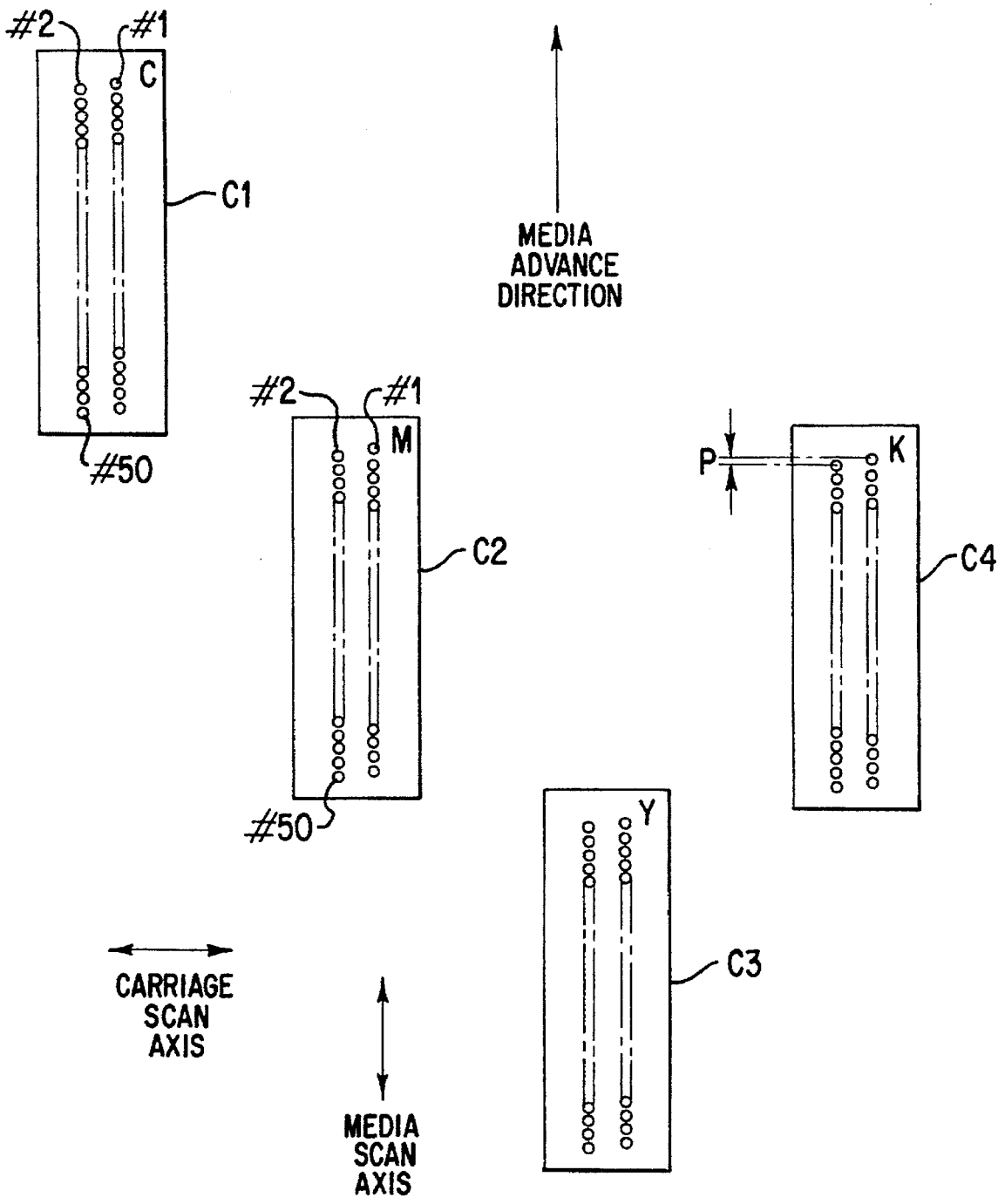
FIG. 8 is a schematic plan view illustrating the nozzle arrays of the staggered CMYK printheads of FIG. 7 as seen looking down toward the media.

Cartridge chutes are sequentially positioned side by side along the carriage scan axis and each is offset relative to an immediately adjacent chute along the media scan axis such that the nozzle arrays of the cartridges C1, C2, C3 supported by the cartridge chutes are non-overlapping along the media scan axis, and the nozzle arrays of the cartridges C2, C4 are in identical positions along the media scan axis, as more particularly shown in FIG. 8. The cartridges C1, C2, C3 comprise non-black color printing cartridges for producing the base colors of cyan, magenta, and yellow commonly utilized in color printing, while the cartridge C4 comprises a black printing cartridge. The staggered arrangement between immediately adjacent pen chutes is readily observed in the top plan view of FIG. 7. The amount of stagger or offset along the media axis between the cartridges is discussed more specifically below in conjunction with the spacing of the nozzles of the nozzle arrays.

Referring now to FIG. 8, schematically depicted therein is the arrangement of the nozzle arrays of the cartridges C1, C2, C3, C4 as viewed from above the nozzles of the cartridges (i.e., the print media would be below the plane of the figure). Each nozzle array of the cartridges C1, C2, C3, C4 includes an even number of nozzles arranged in two columns parallel to the media scan axis, wherein the nozzle columns are staggered relative to each other. By way of illustrative example, each nozzle array includes 50 nozzles which are numbered as 1 through 50, with the 50th nozzle being at the end of the nozzle array that is first encountered by the leading edge of a print medium as it is advanced in accordance with the media advance direction shown in FIG. 8, by which the leading edge of an advancing print medium first encounters the nozzle array of the printhead cartridge C3, then the nozzle arrays the printhead cartridges C2, C4, and finally the nozzle array of the printhead cartridge C1. Print direction as shown in FIG. 8 is such that the cartridge C3, the yellow print cartridge, is the first cartridge to encounter the print media.

The distance along the media scan axis between diagonally adjacent nozzles of each nozzle array, as indicated by the distance P in FIG. 8 for the cartridge C4, is known as the nozzle pitch, and by way of example is equal to the resolution dot pitch of the desired dot row resolution (e.g., 1/300 inch for 300 dpi). In use, the physical spacing between the columns of nozzles in a printhead cartridge is compensated by appropriate data shifts in the swath print data so that the two columns function as a single column of nozzles.

Pursuant to the non-overlapping stagger of the non-black printing cartridges C1, C2, C3 along the media axis, the areas or bands traversed by each of the cyan, magenta and yellow nozzle arrays in each carriage scan are non-overlapping. In this manner, ink drops ejected by the non-black cartridges in a given carriage scan do not fall on top of drops ejected in the same carriage scan, and ink drops of the non-black colors are separate bands in each pass. This allows ink drops to dry before the application of any overlying or adjacent drops of a different color on a subsequent carriage scan and avoids ink bleed due to mixing of liquid ink of different colors. The black cartridge C4 does not need to be offset along the media axis relative to all of the non-black printing cartridges, since dot locations having black dots are not printed with dots of another primary color to produce any secondary colors. Stagger or offset of the cartridges along the media axis also helps to reduce cockle since ink is distributed over a larger area than if the cartridges were side by side in a line along the carriage scan axis.

In a second embodiment of the invention shown in FIGS. 9–13, a plurality of print cartridges are paced in side by side alignment along the carriage scan axis, thereby providing a first same sized pre-heat region for each of the different printhead arrays, and a second same sized post-print heating region for each of the different printhead arrays. In addition, a modified screen platen is used in the heated print zone, particularly to maximize the heat radiation and convection in the post-print heating region, as set forth in more detail hereinafter.

Figure 9:
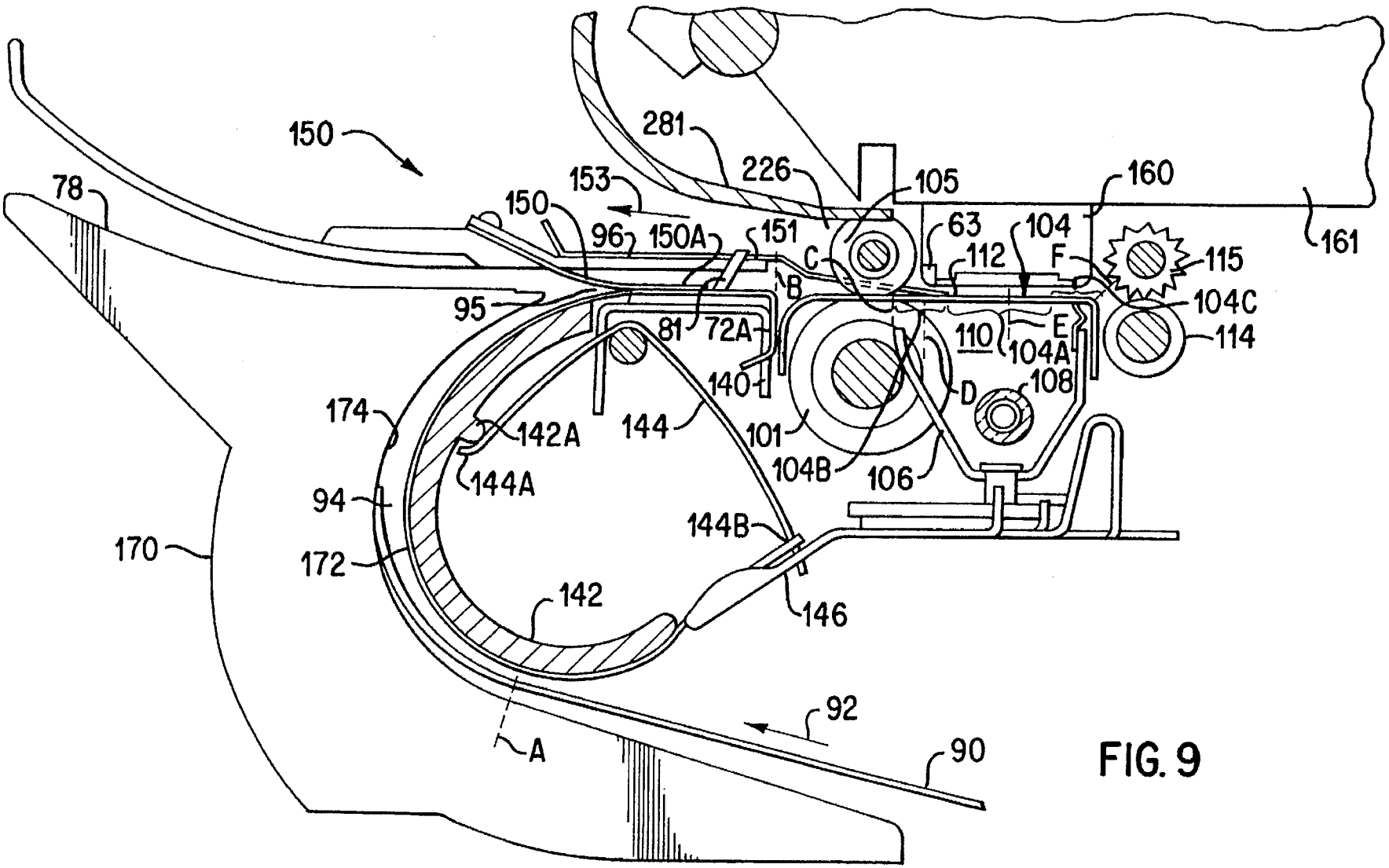
FIG. 9 is a simplified schematic diagram illustrative of a second embodiment of a color inkjet printer embodying the present invention.
Figure 10:
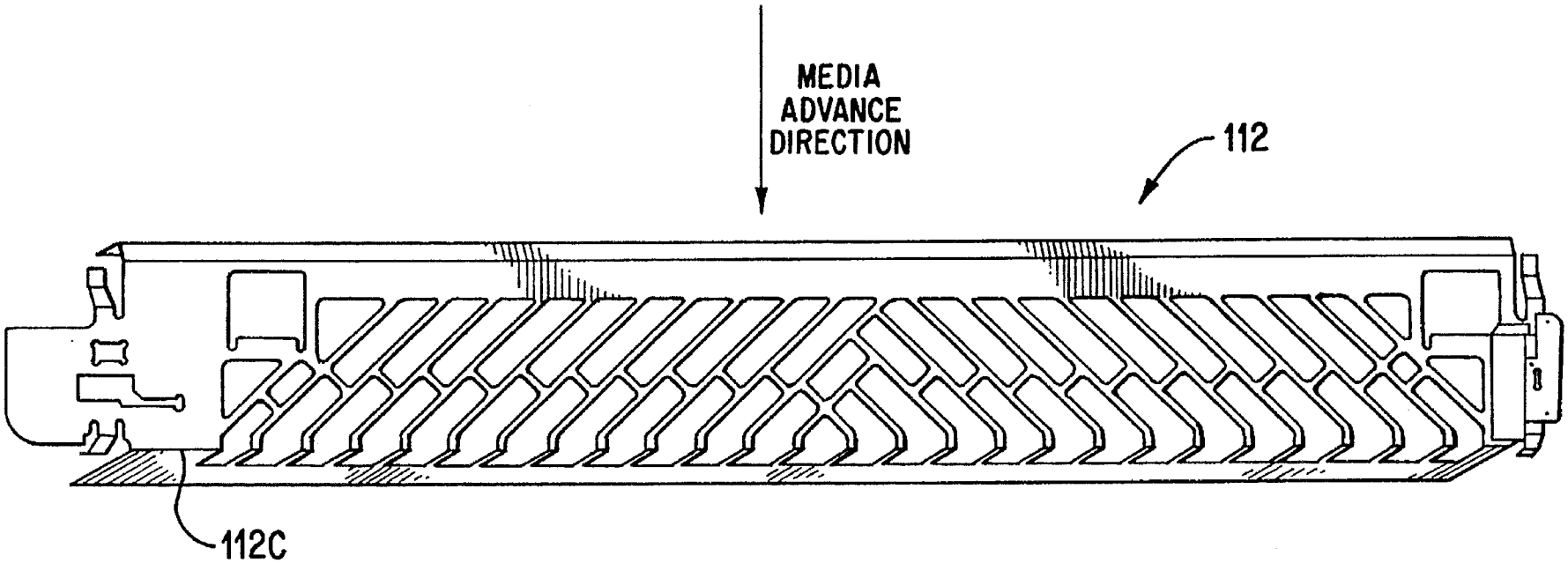
FIG. 10 is top isometric view of the heater screen for the printer of FIG. 9.
Figure 11:
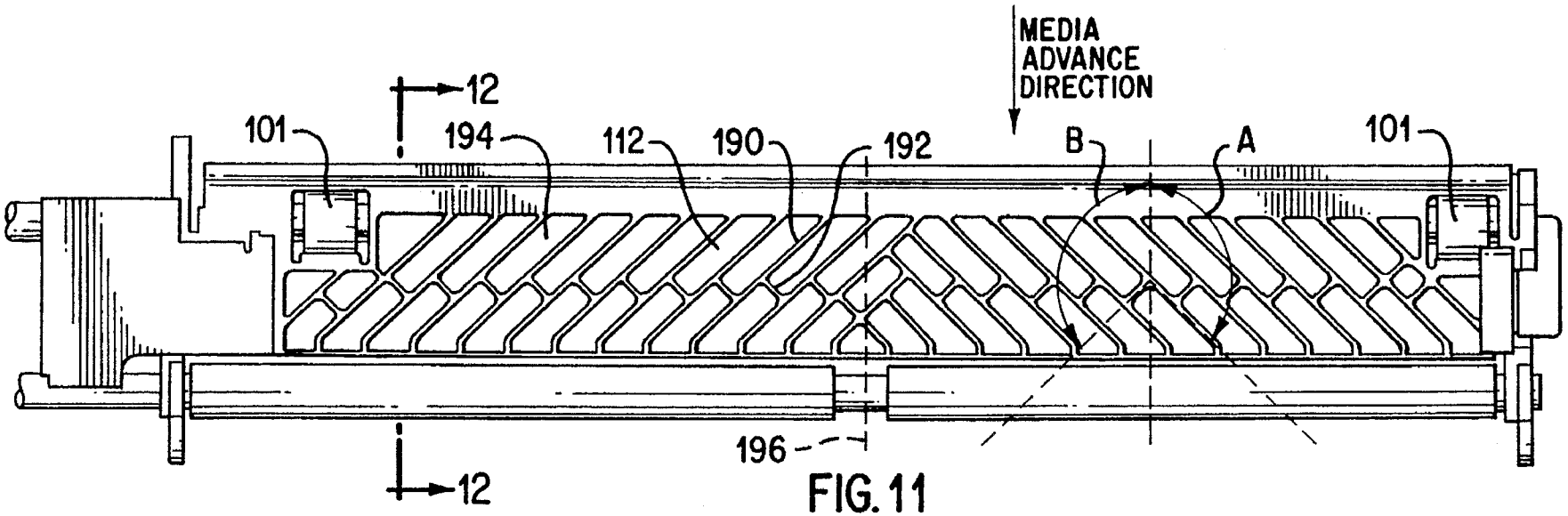
FIG. 11 is a top view of the heater screen and drive rollers for the printer of FIG. 9.

Referring now to FIG. 9, a major portion of the paper path through the printer 150 is illustrated in cross-section. The paper 90 is picked from the input tray and driven into the paper path in the direction of arrow 92. The paper 90 enters the slot 94 defined by the curved surface/74 of member/70 and the preheater/72, contacts the curved contour/74 and is guided around and in contact with the curved surface defined by the preheater/72. A guide 96 is secured above the outlet of the slot 94, and guides the paper to complete the reversal of direction, such that the paper is now headed 180 degrees from the direction its leading edge faced when picked from the input tray.

A flexible bias guide 150 is positioned above the upper guide 140 and preheater/72, so that one edge is in contact with the preheater/72, when no paper is present. The bias guide forces the paper against the preheater/72 to ensure effective thermal energy transfer. The leading edge of the preheated paper 90 is then fed into the nip between drive roller 101 and idler roller 105. With the paper being held against the heater screen 104 by a paper shim 151, the paper 90 is in turn driven past the print area 104, where radiant heat is directed on the undersurface of the paper by reflector 106 and heater element 108 disposed in the heater cavity 110 defined by the reflector. The screen 112 is fitted over the cavity 110, and supports the paper as it is passed through the print zone 104, while at the same time permitting radiant and convective heat transfer from the cavity 110 to the paper 90. The convective heat transfer is due to free convection resulting from hot air rising through the screen and cooler air dropping, and not to any fan forcing air through the heater cavity. Once the paper covers the screen during printing operations, the convection air movement is within the cavity.

At the print area, ink-jet printing onto the upper surface of the paper occurs by stopping the drive rollers, driving the cartridge carriage /61 along a swath, and operating the ink-jet cartridges /60 to print a desired swath along the paper surface. After printing on a particular swath area of the paper is completed, the drive rollers 101 and 114 are actuated, and the paper is driven forward by a swath length, and swath printing commences again. After the paper passes through the print area 104 it encounters output roller 114, which is driven at the same rate as the drive roller 101, and propels the paper into the output tray.

Referring to FIG. 9, the area of the paper path between "A" and "B" is the preheated portion of the paper path. The area between "B" and "C" is an unheated portion of the paper path. The print zone 104A at which ink-jet printing by cartridges 60 occurs is centered at "E". The area 104B between "C" and "D" is heated by element 108, and represents an additional preheating zone adjacent the print zone at E. The area 104C between "E" and "F" is also heated by element 108, and is an area of post-print-heating of the medium.

In a preferred embodiment, the driver rollers 101 engage the paper adjacent opposed edges thereof. The rollers have a width dimension of 0.365 inches in this example, smaller than the margin width forward. The print area is forward of the drive rollers 101 so that the drive rollers do not interfere with printing operations.

The print area screen 112 in this embodiment is further illustrated in FIGS. 10–12 & 14, and performs several functions. It supports the paper at the print area 104 and above the heater reflector 106. The screen is strong enough to prevent users from touching the heater element 108. The screen transmits radiative and convective heat energy to the print medium, while transmitting little if any conductive heat energy, which would cause print anomalies, due to nonuniform heat transfer. The screen 112 is designed such that the print medium does not catch a surface of the screen as it is driven through the print area.

The screen 112 performs these functions by the placement of a network of thin primary and secondary webs, nominally 0.032 inches (0.75 mm) in width, which outline relatively large screen openings. Exemplary ones of the primary and secondary webs are indicated as respective elements 190 and 192 in FIG. 11; exemplary screen openings are indicated as 194. The secondary webs 192 provide additional strength to the web network.

The screen 112 is preferably made from a high strength material such as stainless steel, in this embodiment about 0.010 inches in thickness. The openings 194 can be formed by die cutting or etching processes. The screen is processed to remove any burs which might catch the medium.

Figure 12:
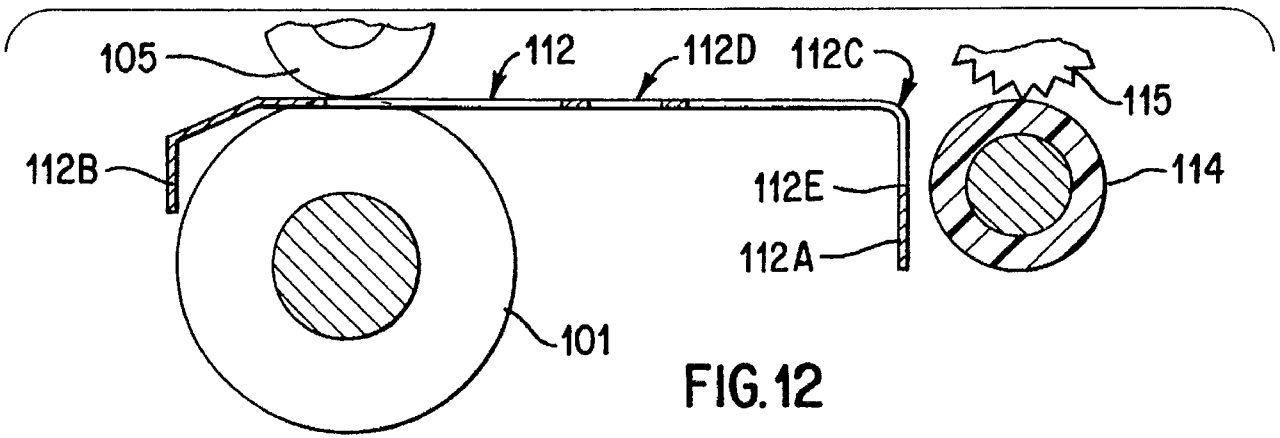
FIG. 12 is a cross-sectional view taken along line 12—12 of FIG. 11.

FIG. 12 shows a cross-sectional view of the one-piece member defining the screen 112, bent at one edge to define flange 112A, and bent at the other edge to define flange 112B. The web network is wrapped around the edge 112C such that it is defined not only on the horizontal surface 112D of the screen but also on the flange 112A, down to line 112E. This permits radiant heat to escape through the flange openings as well as the openings defined in the horizontal surface 112D, thereby expanding the post-printing heating area.

Typical dimensions for the screen include a screen opening pattern width (i.e., the dimension in the direction of medium travel) of 0.562 inches (14.28 mm), and opening 194 width and length dimensions of 0.194 inches (4.92 mm) and 0.777 inches (19.74 mm), respectively. The print area width (in the direction of medium travel) for the exemplary printhead comprising cartridge 60 of this embodiment is 0.340 inches (8.64 mm) covering the region subtended by each of the aligned printheads on the four print cartridges. The print cartridges are aligned in this embodiment; the cartridges could alternatively be staggered.

Referring again to FIG. 11, the screen grid pattern is essentially a mirror image about the center axis 196. Viewed from the edge at flange 112B of the screen 112 initially traversed by the print medium, the primary webs 190 are at a first obtuse angle A, in this exemplary embodiment, 135 degrees. The secondary webs 192 are at a second obtuse angle B relative to this edge which in this embodiment is 135 degrees. These angles are selected in order to provide a web network which has the requisite strength to prevent users from touching the heater element 108 and yet which permits the ready transfer of radiant and convective heat energy from the radiator cavity to the print medium.

The angle A of the primary webs 190 is determined by several factors. The web angles must first meet the requirement that the leading edge of the medium not catch on the webs as the medium is advanced. The web angles are also selected in dependence on the medium advance distance between adjacent print swaths. This distance is determined by the number of print nozzles and the print mode. In this exemplary embodiment, the printhead comprises two rows of 52 print nozzles each, spaced over a distance of 0.340 inches (8.64 mm). Thus, the total width of the area subtended by the printhead in this exemplary embodiment is 0.340 inches (8.64 mm). For a single pass mode the medium advance distance for each successive swath is 0.32 inches, i.e., the width of the area subtended by the print nozzle of a single one of the print cartridges. For a three pass mode, the distance is one-third the single pass distances, or 0.107 inches. For the six pass mode, the distance is 0.053 inches, i.e., one-sixth the medium advance distance for the single pass mode.

The width of the screen opening pattern is determined in the following manner for this exemplary printer embodiment. The opening pattern width can be considered to have three regions, the first region 104B between "C" and "D" in FIG. 7 a pre-heat region for preheating the advancing medium before reaching the active print zone. The second region 104A at E is the active print zone, i.e., the area subtended by the print nozzles comprising the printhead. In this embodiment, this area is defined by the nozzle coverage of the print cartridges. The third region 104C between "E" and "F" is a post-print heating region, reached by the medium after being advanced through the active print zone. In this embodiment, the pre-heat region width is equal to five three-pass medium advancement distances, or about 0.54 inches. The active print zone region centered at "E" has a width of 0.340 inches, as described above. The post-print heating region has a width equal to two three-pass mode increment distances, or 0.22 inches. The three regions aggregate approximately 1.1 inches in this embodiment.

The web angles are selected to as not to continuously shield the same area on the print medium from the radiant heat energy. The problem is evident if one considers the use of vertical webs, i.e., webs which are parallel to the direction of advancement of the medium, which obviously would not catch the medium as it is advanced. However, the same areas of the medium, those disposed over webs, will be shielded from the print cavity as the medium is advanced, and this area will dry differently than unshielded areas, showing the vertical web pattern.

By way of example, the preferred embodiment, with a primary web angle of 135 degrees, employs a vertical spacing distance D between adjacent primary webs 190 of approximately 8.13 mm (0.32 inches), wherein a three pass medium advance distance is 2.7 millimeters (0.107 inches).

Figure 13:
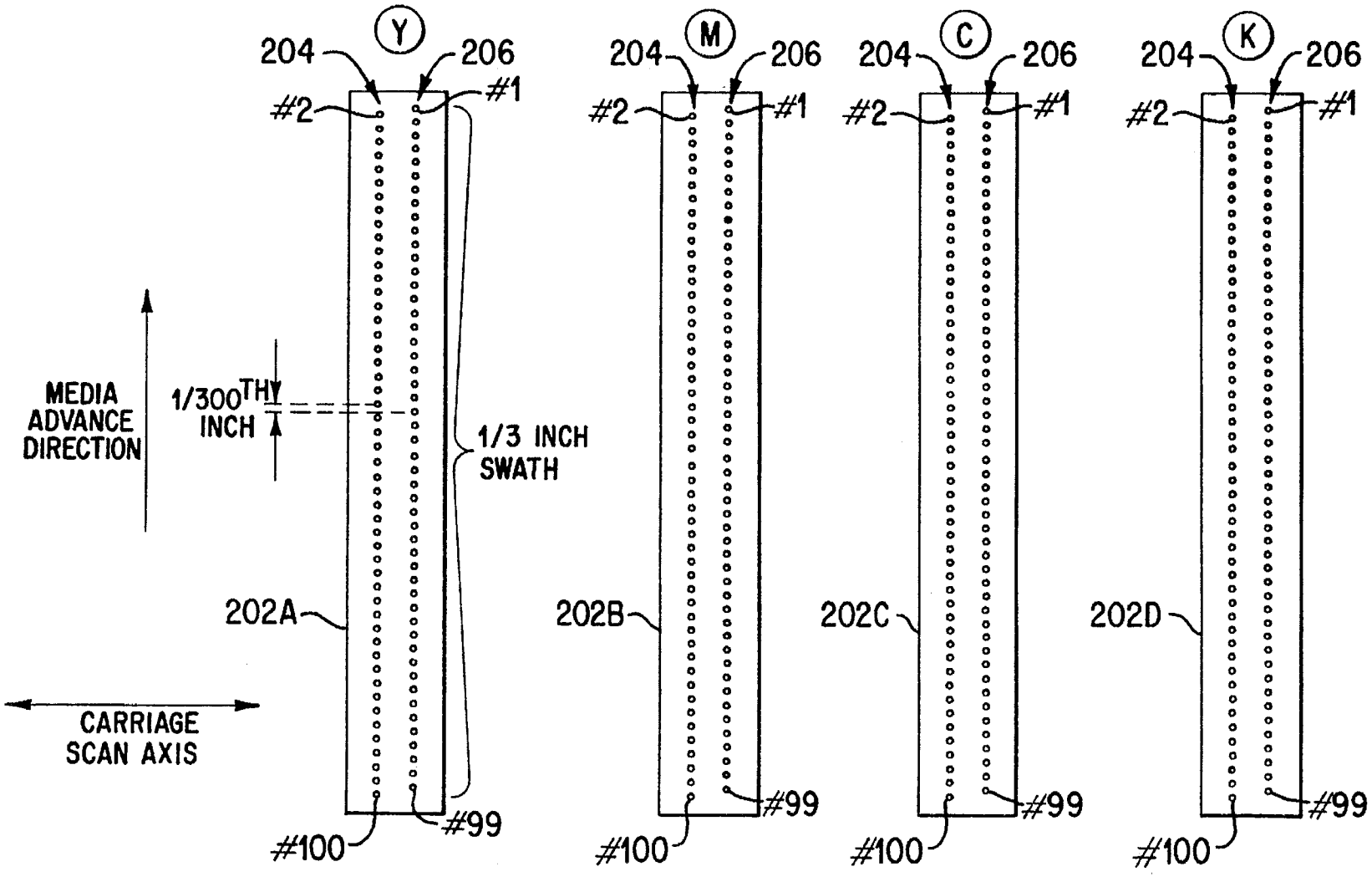
FIG. 13 is a schematic plan view illustrating the nozzle arrays of aligned YMCK printheads of the printer of FIG. 9 as seen looking up from the media.
Figure 14:
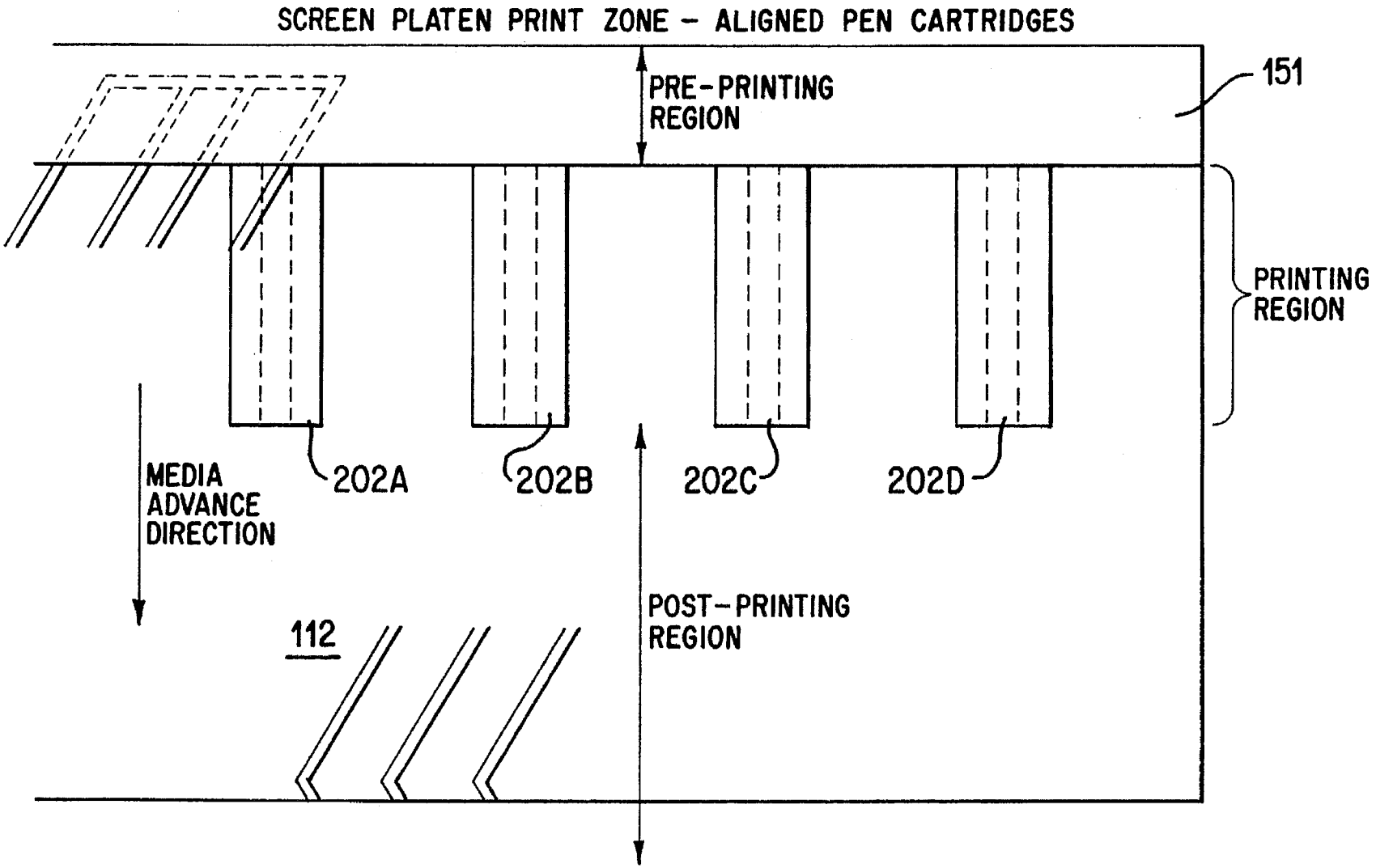
FIG. 14 is a schematic view looking down on the positioning of the aligned printheads of FIG. 13 over the heater screen of FIG. 10.

Referring more particularly to FIGS. 13–14, print cartridges 202A–D each employ a array of one hundred active nozzles composed of a column of even numbered nozzles 204 and a column of odd numbered nozzles 206 which together form the equivalent of a single column of one hundred nozzles having a pitch of 1/300th inch between adjacent nozzles in the media advance direction. In fact, each array has one hundred four nozzles, but four nozzles in each array are selectively de-activated at one and/or another end of each column in order to achieve substantial alignment of one hundred nozzles between all four of the cartridges. Accordingly, the printer of this second embodiment is capable of producing a printing swath one third of an inch across its width, thereby providing a greater throughput than the printer of the first embodiment.

Moreover, by extending the screen platen 112 to be under the paper shim 151, additional media heating/drying is provided in the pre-heated portion of the print zone; by extending the screen platen to bend downwardly to form vertical flange 112 A, additional ink drying is provided in the post-print heating region of the print zone. Since this heating in the three regions of the print zone is done by radiation and convection through the screen, rather by merely by conduction, it is believed that more efficient controllable and evenly distributed heating is provided in a safe manner without using excessivly high energy inputs to the heater unit.

It is understood that the above-described embodiments are merely illustrative of the possible specefic embodiments which may represent principles of the present invention. Other arrangements may readily be devised in accordance with these principles by those skilled in the art without departing from the scope and spirit of the invention as set forth in the following claims.

We claim as our invention:

1. A method of color inkjet printing, comprising the steps of:

passing media along a media path through a print zone across a first side of a stationary and non-rotating screen platen located in the print zone, said screen platen comprising an opening pattern defined in a screen platen surface, the screen platen and the opening pattern adapted to allow transfer of radiant and convective heat energy through the opening pattern while transmitting little if any conductive heat energy to said media as it is passed through the print zone;

applying ink at a given time to a first portion of the media which first portion partially overlies the screen platen;

generating said radiant heat energy on another side of the screen platen; and transferring the radiant heat energy produced by said generating step through the opening pattern in the screen platen to the media in the print zone at the first media portion actually receiving ink during the given time as well as to a media portion not receiving ink during the given time, said transferring of heat resulting in accelerated drying of said ink applied to the media, and wherein little if any of said heat energy is transferred to the media by conduction to thereby minimize print anomalies due to nonuniform heat transfer.

2. The method of claim 1 wherein said transferring step includes transferring heat energy through the opening pattern in the screen platen surface by convection.

3. The method of claim 1 wherein said transferring step includes transferring heat energy to a second portion of the media in the print zone which said second portion has already received ink.

4. The method of claim 1 wherein said transferring step includes transferring heat energy to a third portion of the media in the print zone which said third portion is about to receive ink.

5. The method of claim 1 wherein said generating step includes generating heat energy from a heat element located in a reflector box.

6. The method of claim 1 wherein said applying step includes applying ink from a plurality of ink cartridges.

7. The method of claim 6 wherein said applying step includes applying ink from a black ink cartridge and at least one color ink cartridge.

8. The method of claim 1 wherein said applying step includes applying ink from a plurality of color ink cartridges.

9. Printer apparatus for applying ink to media, comprising:

a printhead member;

a stationary, non-rotating screen platen for supporting the media in a print zone having a first portion of the print zone where ink is actually applied to the media, and other portions of the print zone where ink is not applied to the media, said screen platen comprising an opening pattern defined in a screen platen surface, the screen platen and the opening pattern adapted to allow transfer of radiant and convective heat energy through the opening pattern while transmitting little if any conductive heat energy to said media as it is passed through the print zone;

drive means for moving the media relative to said printhead member and said screen platen; and a heat generator located adjacent a side of said screen platen such that said screen platen is interposed between said print zone and said heat generator, said heat generator for transferring said radiant heat through said opening pattern in said screen platen surface to said first portion and said other portions of the print zone, said transferring of heat resulting in accelerated drying of said ink applied to the media, and wherein little if any of said heat energy is transferred to the media by conduction to thereby minimize print anomalies due to nonuniform heat transfer.

10. The printer apparatus of claim 9 wherein said other portions of the print zone includes a pre-printing portion of the print zone.

11. The printer apparatus of claim 9 wherein said other portions of the print zone includes a post-printing portion of the print zone.

12. The printer apparatus of claim 9 wherein said heat generator generates heat by radiation.

13. The printer apparatus of claim 9 wherein said heat generator generates heat by convection.

14. Printer apparatus having a plurality of inkjet cartridges for applying ink to media, comprising:

a carriage for holding the inkjet cartridges;

a stationary, non-rotating screen platen for supporting the media in a print zone, said screen platen having a first portion where ink is actually applied to the media, a second portion pre-printing portion, and a third post-printing portion, said screen platen comprising an opening pattern defined in a screen surface, the screen platen and the opening pattern adapted to allow transfer of radiant and convective heat energy through the opening pattern while transmitting little if any conductive heat energy to said media as it is passed through the print zone;

means for allowing said carriage to move relative to the media to locate the inkjet cartridges adjacent to said first portion of said print zone;

means for moving the print media along a media path and in relation to said inkjet cartridges and said screen platen;

heat generator means for transferring said radiant heat through said opening pattern at said first, second and third portions of said screen platen, the screen platen interposed between the print zone and the heat generator means, said transferring of heat resulting in accelerated drying of said ink applied to the media, and wherein little if any of said heat energy is transferred to the media by conduction to thereby minimize print anomalies due to nonuniform heat transfer.

15. The printer apparatus of claim 14 wherein said carriage holds at least two inkjet cartridges in staggered positions along a media advance axis to create offset print swaths during a single pass of the carriage through said print zone.

16. The printer apparatus of claim 14 wherein said carriage holds at least two inkjet cartridges in aligned positions to create overlapping print swaths during a single pass of the carriage through said print zone.

17. The printer apparatus of claim 14 wherein said screen platen includes a main screen surface for supporting the media in said print zone, and said screen platen also includes a screen flange in said third post-printing portion which does not support the media in said print zone.

18. The printer apparatus of claim 14 which further includes a hold-down member for holding media against said screen platen, and wherein said screen platen includes a screen portion underlying said hold-down member.

19. The printer apparatus of claim 14 wherein said heat generator means includes an air passageway and a reflector element for transferring heat to said print zone through said opening pattern in said screen surface by convection and by radiation.

* * * * *

UNITED STATES PATENT AND TRADEMARK OFFICE

CERTIFICATE OF CORRECTION

PATENT NO. : 5,668,584
DATED : September 16, 1997
INVENTOR(S) : Broder, et. al.

It is certified that error appears in the above-identified patent and that said Letters Patent is hereby corrected as shown below:

At Column 3, line 57, after "media hold" insert ---down member--.

At Column 11, line 55, delete "specefic" and insert in lieu thereof --specific--.

Signed and Sealed this

Tenth Day of March, 1998

Bruce Lehman

*Attest:*

BRUCE LEHMAN

*Attesting Officer*

*Commissioner of Patents and Trademarks*